United States Patent [19]

En-Jian et al.

[11] Patent Number: 4,884,628

[45] Date of Patent: Dec. 5, 1989

[54] HEAT PIPE EMPLOYING HYDROGEN OXIDATION MEANS

[76] Inventors: Chen En-Jian; Lin Zhaorong; Chen Li-ying, all of Guangzhou Institute of Energy Conversion, Chinese Academy of Sciences, 81 Central Martyrs' Road, Guangzhou, China

[21] Appl. No.: 260,210

[22] Filed: Oct. 19, 1988

[51] Int. Cl.[4] ..... F28D 15/02

[52] U.S. Cl. ..... 165/104.27; 165/917

[58] Field of Search ..... 165/104.27, 917, 134.1

[56] References Cited

U.S. PATENT DOCUMENTS 4,782,890 11/1988 Shimodaira et al. ..... 165/104.27

*Primary Examiner*—Albert W. Davis, Jr.

*Attorney, Agent, or Firm*—William W. Habelt

[57] ABSTRACT

A heat pipe (10) comprises an elongated sealed tubular enclosure (20) defining a closed working cavity (50) and having water disposed within the working cavity as the working fluid. The enclosure (20) being formed of a material which reacts with water to generate hydrogen gas. Oxidizer means (30) is disposed within the working cavity (50) in the condenser portion (25) of the heat pipe (10). The oxidizer means (20) comprises a substance which will react with the hydrogen gas generated during operation of the heat pipe to oxidize said hydrogen gas into water. Suitable substances include metal oxides, such as CuO, $PhO_2$, $MnO_2$ and HgO, having an electrode potential (or reduction potential) which is higher than that of hydrogen, i.e., the electrode potential (or reduction potential) of such a suitable metal oxide should be a positive potential relative to the zero electrode potential of hydrogen. Overall, the preferred oxidizer is CuO or mixture containing CuO, most preferably, a sintered mixture containing Cu and CuO with a small amount of $Cr_2O_3$.

18 Claims, 1 Drawing Sheet

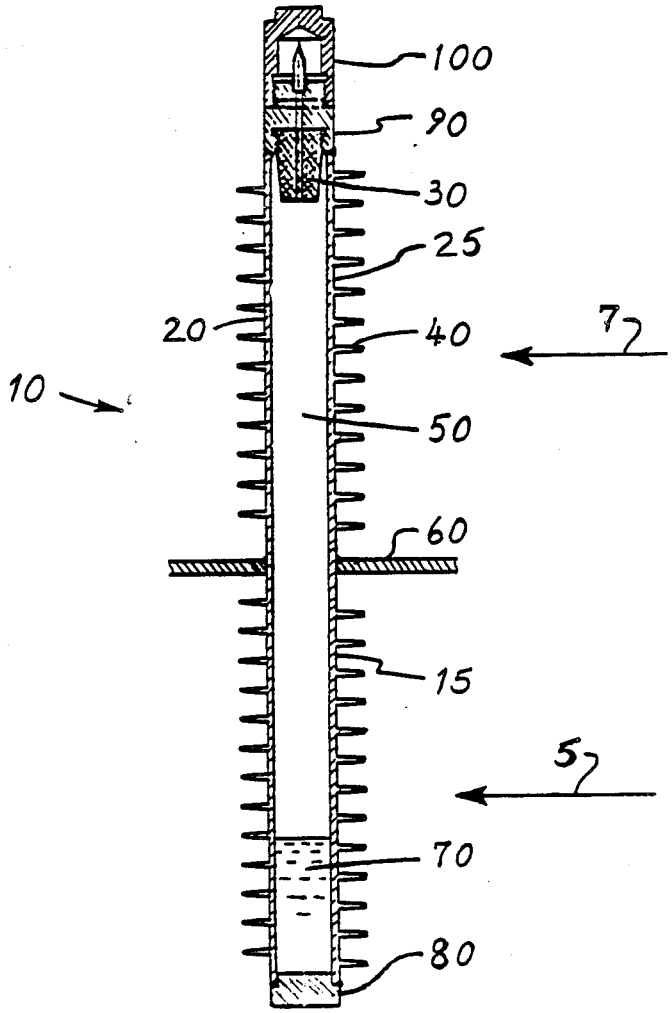
100
90
30
25
20
40
7
10
50
60
15
5
70
80

HEAT PIPE EMPLOYING HYDROGEN OXIDATION MEANS

The present invention relates generally to heat pipes, in particular to heat pipes using water or other hydrogen containing liquid as the working fluid and formed of a material which reacts with the working fluid to produce non-condensible hydrogen gas. More specifically, the present invention relates to improving the performance characteristics of such heat pipes by providing within the condenser portion of the heat pipe means for oxidizing any hydrogen gas formed during operation of the heat pipe.

Steel-water heat pipes, that in heat pipes having a steel enclosure and employing water as a working fluid, have been widely used in heat exchange applications throughout industry. Such heat pipes include, for example, closed thermosiphons, heat pipes having porous wicks, and rotating heat pipes. Steel heat pipes are those wherein the heat pipe enclosure defining the working cavity of the heat pipe is made of an iron alloy, such as carbon steel or stainless steel, or iron or any iron alloy containing a metal lying above hydrogen gas in the electromotive series, such as nickel, chromium, manganese, and others. It is well known that when such steel heat pipes are placed in operation, a series of chemical reactions will typically occur between the water working fluid and the steel wall of the heat pipe cavity at the temperatures at which the heat pipes are generally utilized. It is generally considered that the principal reactions are:

$$Fe + 2H_2O \xrightarrow{\text{heated}} Fe(OH)_2 + H_2\uparrow$$
$$3Fe(OH)_2 \xrightarrow{>120^\circ\text{ C.}} Fe_3O_4.x\,H_2O + H_2\uparrow + H_2O$$

As a result of these reactions, non-condensible hydrogen gas is generated which gradually accumulates within the working cavity of the heat pipe in the condenser end thereof. As this hydrogen gas accumulates in the condenser portion of the working cavity of the heat pipe, it hampers flow of the vapor phase of the working fluid within the condenser portion of the heat pipe, and also acts as an insulator and retards the heat transfer to the vapor phase of the working fluid thereby interfering with the condensation phase change and consequently seriously decreasing the heat exchange effectiveness of the heat pipe. In wicked heat pipes, it is believed that the hydrogen gas may even accumulate in the wick in the condenser portion of the working cavity to the extent that an annular layer of hydrogen gas is formed about the wall of the condenser portion of the working cavity thereby effectively preventing condensation of the vapor phase of the working fluid.

Several solutions have been proposed to address the problem of hydrogen gas accumulation in such heat pipes. One method is to improve the chemical compatibility of the heat pipe enclosure with the working fluid. With water as the working fluid, it is known to provide a protective layer on the inner surface of the steel heat pipe enclosure to effectively line the heat pipe cavity to prevent contact between the water and the steel enclosure. The protective layer must be made of a material which will not react with the water. Typically, copper is selected as the protective lining since it is known not to react with water at the working temperature typically encountered in industrial uses. One such heat pipe, known as a duplex-tube heat pipe, is formed of an inner copper tube force fit within an outer stainless steel pipe. Such duplex-tube heat pipes have been commonly employed in industrial heat exchangers such as gas-to-air heat exchangers used to preheat combustion on fossil-fuel steam generators. However, such duplex-tube heat pipes are difficult and expensive to manufacture. Also, complete integrity of the copper lining can not be ensured over long periods of operation and eventual contact between steel and water can not be completely precluded. Therefore, even in such copper-lined heat pipes, hydrogen gas is likely to be formed and accumulate slowly over time when water is used as the working fluid, thereby limiting the effective service life of the heat pipe.

Rather than selecting for use in forming the enclosure of the heat pipe cavity a metal which is compatible with the working fluid, it has also been suggested to select a working fluid which is chemically compatible with the steel heat pipe enclosure. For example, it has been proposed that ammonia be utilized as the working fluid in steel heat pipes as ammonia does not appear to react with the steel enclosure to form non-condensible hydrogen gas. Although theoretically the use of ammonia as a working fluid should solve the problem, in practice small amounts of water are invariably contained in the ammonia which will react with the steel pipe to form the undesirable non-condensible hydrogen gas as discussed in U.S. Pat. No. 4,586,561. Other common working fluids used in heat pipes are generallly hydrocarbon fluid based. As these hydrocarbon fluids break down or deteriorate over a period of time, hydrogn gas may also be released either directly from breakdown of the hydrocarbon fluid or reaction of the breakdown products with the steel enclosure. Additionally, water may also be present in small amounts as a contaminant in hydrocarbon based working fluids.

An alternative approach to addressing the accumulation of hydrogen gas in steel-water heat pipes is to provide a means of alleviating the accumulation of the hydrogen gas within the heat pipe cavity, rather than attempting to prevent its formation. One such approach is to release the accumulated hydrogen gas from the heat pipe cavity by some form of vent means. For example, a valve assembled on the end of condensation section of the heat pipe can be used to release accumulated hydrogen gas periodically when heat pipe is in operation. But this way has obviously disadvantages, e.g., the operation of the valves is troublesome and inconvenient, secondly, unavoidable leakage of the valves may shorten the service life of the heat pipe. Another example, as disclosed in U.S. Pat. No. 3,503,438, is a palladium vent tube sealed to the wall of heat pipe and having a closed inner end and an open outer end to allow the hydrogen gas to continually permeate through the palladium out of the heat pipe. But palladium is a rare and precious metal, and for both reasons of cost and availability can not be widely used in industrial applications.

Another approach is remove the hydrogen gas from the heat pipe cavity by adsorption. To do so, it is known to place a hydrogen getter material within the heat pipe cavity within the condenser portion of the heat pipe. A getter material is a substance which binds a gas on its surface. Hydrogen getters proposed for use in heat pipes include tantalum, titanium, and niobium as disclosed in U.S. Pat. No. 4,043,387; lanthanum, yttrium or scandium, combined with barium, calcium or lithium as disclosed in U.S. Pat. No. 4,159,737; or a zirconium intermetallic alloy, such as $ZrMn_2$ alloy, as disclosed in U.S. Pat. No. 4,586,561. However, in addition to being very costly for use in heat pipes for industrial application, such hydrogen getters typically are capable of adsorbing less hydrogen gas as temperature increases. Thus, such hydrogen getters are effective in heat pipes only under conditions of relativeley low working temperature such as experienced when used for permafrost stabilization as discussed in the aforementioned U.S. Pat. No. 4,586,561, but would be much less effective in heat pipes used in industrial applications such as gas-to-gas heat exchange, wherien the condenser portion of the heat pipe would commonly be exposed to gas temperatures of at least 500° F.

Accordingly, it is an object of the present invention to provide a heat pipe suitable for industrial heat exchange application, in particular gas-to-gas heat exchange, wherein the heat pipe is equipped with a low cost means of eliminating hydrogen gas from the heat pipe cavity by oxidizing hydrogen gas formed in the heat pipe cavity into water.

SUMMARY OF THE INVENTION

The heat pipe of the present invention includes an enclosure defining a closed working cavity and water disposed within the working cavity as the working fluid, the enclosure being formed of a material which reacts with water to generate hydrogen gas. Oxidizer means is disposed within the working cavity in the condenser portion of the heat pipe, the oxidizer means comprising a substance which will react with the hydrogen gas generated during operation of the heat pipe to oxidize said hydrogen gas into water. In general, the requirements for such a substance are that, it can not be decomposed under the working temperature of the heat pipe, can not be dissolved in the water, and can not react with water or steam, but it should react with hydrogen to form the water and another product whose physicochemical properties are stable and its saturated steam pressure almost equal to zero under the working temperature of the heat pipe.

Such oxidizer substances comprise those metal oxides having an electrode potential (or reduction potential) which is higher than that of hydrogen, i.e., the electrode potential (or reduction potential) of such a suitable metal oxide should be a positive potential relative to the zero electrode potential of hydrogen. Such metal oxides are able to cause a redox reaction with hydrogen and are suitable for use as the oxidizer means in the heat pipe of the present invention.

Examples of suitable metal oxides include, inter alia, CuO, $PbO_2$, $MnO_2$, and HgO. Mixtures of such metal oxides and compounds containing such metal oxides or chemicals which can produce such metal oxides by heating also may be used as the oxidizer means in the heat pipe of the present invention. From view point of effect and cost, the preferred oxidizer is CuO or mixture containing CuO, most preferably, a sintered mixture containing Cu and CuO with a small amount $Cr_2O_3$.

The oxidizer means of the present invention may be disposed in the heat pipe in block, granular, thread, powder or specially shaped form easily put in place. Preferably, the oxidizer means has a porous structure for increasing the available contact area with hydrogen. The oxidizer means may be disposed in a gas permeable container with good structural strength, e.g., a pocket made of iron or copper wire meshes with fine mesh, or made in form of special shape block designed to be inserted in the end of condenser portion of the heat pipe.

BRIEF DESCRIPTION OF THE DRAWING

The FIG., the sole drawing, is a sectional side elevation view of the heat pipe of the present invention with the hydrogen gas oxidizer means disposed in the working cavity at the condenser end of the heat pipe.

DETAILED DESCRIPTION OF THE PREFERRED EMBODIMENT

Referring to the drawing, there is depicted therein a heat pipe 10 of the type commonly referred to as the closed thermosiphon type. The heat pipe 10 comprises a tubular enclosure 20 which defines a closed working cavity 50 wherein a working fluid 70 is enclosed. End caps 80 and 90 are inserted in the ends of the tubular enclosure 20 in sealing relationship to seal the open ends of the tubular enclosure 20 and close the working cavity 50 to prevent either the liquid or vapor phase of the working fluid 70 from escaping out of the working cavity.

The outer surface of the heat pipe 10 is provided with fins 40, shown as spiral wound outwardly extending surface, which serves to increase the gas to metal contact surface of the heat pipe thereby increasing the heat transfer effectiveness between the heating gas and the gas to be heated and the heat pipe 10. Preferably, the inner surface of the enclosure 20 is provided with a wick in the conventional, well known manner to enhance heat transfer through the enclosure 20 to the working fluid 70 within the working cavity 50.

In operation, such as in gas-to-gas heat exchange as illustrated in the drawing, the heat pipe 10 is mounted in the division wall 60 of the heat exchanger which separates the heat exchanger into a first flowpath for the heating gas 5 on one side of the division wall and a second flowpath for the gas 7 to be heated on the opposite of the division wall. As the higher temperature heating gas 5 passes over the evaporator portion 15 of the heat pipe 10, a portion of the working fluid 70 is evaporated as it absorbs heat transferred from the heating gas 5 through the wall of the evaporator portion 15 of the enclosure 40. The vapor phase of the working fluid 70 passes into the condenser portion 25 of the heat pipe 10. As the cooler temperature gas 7 to be heated passes over the condenser portion 25 of the heat pipe 10, the vapor phase of the working fluid 70 is condensed as it releases heat through the wall of the condenser portion 25 of the enclosure 40 to the cooler temperature gas 7. The condensed liquid phase of the working fluid then flows back into the evaporator portion 15 of the heat pipe 10 and the cycle is repeated.

As noted previously, when the working fluid 70 is a hydrogen containing fluid and the enclosure 40 of the heat pipe is made of a material which reacts with the working fluid, the reaction of the enclosure with the working fluid results in the formation of non-condensible hydrogen gas in the working cavity 50. Generation of hydrogen gas within the working cavity 50 is particularly prevalent when water is the working fluid 70 and the enclosure 40 is made of ferrous metal or alloy such as carbon steel, stainless steel or iron-nickel alloys.

In order to prevent the accumulation of the non-condensible hydrogen gas within the working cavity 50 in accordance with the present invention, hydrogen oxidizer means 30 is disposed within the working cavity 50 in the condenser portion 25 of the heat pipe 10. In the embodiment illustrated in the drawing, the oxidizer means 30 is in the form of a plug-like block which is inserted through and its base threaded into a central hole in the upper end cap 90 so that oxidizer means 30 extends into and is disposed within the working cavity 40 in the condenser portion 25 of the heat pipe 10. A protective cap 100 is then threaded over the base of the oxidizer means 30 to protect the base end of the oxidizer means 30 from the gas flowing over the heat pipe 10 when it is placed in service.

The oxidizer means 30 of the present invention comprises a substance which is insoluble in the working fluid and which is capable of reacting with hydrogen gas to give up elemental oxygen to oxidize the hydrogen to water. Particularly suitable as substances for forming the oxidizer means 30 of the present invention are metal oxides which have an electrode potential (or reduction potential) higher than that of hydrogen, that is a positive electrode potential with respect to hydrogen. Examples of suitable metal oxides include CuO, $PbO_2$, $MnO_2$ and HgO, among other. The oxidizer means 30 may also comprise a mixture or compound containing such a metal oxide or a material which when heated to the working temperature of the heat pipe will produce such a metal oxide.

Particularly advantageous for use as the oxidizer means 30 of the present invention in steel-water heat pipes is cupric oxide, i.e., CuO, or a mixture containing cupric oxide. Cupric oxide and mixtures containing cupric oxide has been found to be most effective as a hydrogen oxidizer at working temperatures around 160° ~~C.~~ (320°~~F.~~). In applications where the condenser portion 25 of the heat pipe 10 is operated at temperatures substantially below 160° C., the effectiveness of the cupric oxide as a hydrogen oxidizer may be increased and the elimination of the hydrogen gas sped up by heating the portion of the working cavity wherein the oxidizer means 30 is disposed so as to raise the temperature of the oxidizer means 30.

Moreover, it has been discovered that a mixture of copper and cupric oxide may be produced which exhibits effectiveness as a hydrogen oxidizer means at temperatures as low as about 115° C. (240° F.) by sintering the mixture in air. More specifically, an effective low temperature hydrogen oxidizer comprises a mixture of about one part by weight copper and four parts by weight cupric oxide, which mixture is pressed into a porous shape, generally a plug shaped block although any desired shape may be used, and then sintered in air at a temperature of about 800° C. for a period of about one to two hours. The addition of a small amount of chromium oxide, $Cr_2O_3$, preferably about 3% by weight, to the copper cupric oxide mixture prior to sintering was found to further enhance the effectiveness of the resultant sintered body as a hydrogen oxidizer when utilized as the oxidizer means in the heat pipe of the present invention.

An alternative low temperature hydrogen oxidizer suitable for use as the oxidizer means of the present invention comprises a mass of sintered copper wire. To produce the sintered copper wire, a plurality of copper wires are sintered in air at a temperature of about 820° C. for a period of about 2 to 4 hours to produce a layer of cupric oxide on the copper wire.

It is to be understood that the oxidizer means 30 may be used as the sole mechanism for combating hydrogen accumulation in steel-water heat pipes or it may be used in conjunction with other methods of improving the chemical enclosure such as the coating of the inner surface of the working cavity 40 with a passivation layer or the inclusion of a corrosion retarding chemical dissolved in the working fluid, both of which provisions would reduce with rate of hydrogen gas generation by retarding the reaction of the water 70 with the steel enclosure 40.

The heat pipe of the present invention includes oxidizer means 30 for oxidizing the hydrogen gas generated in the heat pipe working cavity to water which unlike prior art devices, serves to produce water. Thus, steel-water heat pipes incorporating the oxidizer means 30 may be referred to as "recovery type" heat pipes in that the working fluid, i.e., water, destroyed by reaction with the steel enclosure is regenerated by the oxidizer means 30. In prior art heat pipes employing a palladium or palladium alloy vent tube, the hydrogen gas accumulating in the working cavity of the heat pipe is vented to the exterior of the heat pipe rather than recovered as working fluid. Similarly, in prior art heat pipes employing the various known hydrogen getters, the hydrogen gas is collected or adsorbed on the getter rather than recovered as working fluid.

The heat pipe of the prevent invention is simple and cost effective to manufacture, only differing from prior art steel-water pipes customarily used in the industry in the inclusion of a small amount of oxidizer substance within the working cavity. However, the presence of the oxidizer extends the effective service life of the steel-water heat pipe by several times, and as the heat pipe of the present invention will retain excellent heat transfer performance until eventual failure of its enclosure by wearing and corroding, the advantage is obvious. Heat pipe heat exchangers incorporating the heat pipes of the present invention have particular application in the field of industrial waste heat recovery for gas-to-gas heat exchange, such as combustion air preheating or flue gas reheating.

Although the heat pipe of the present invention has been described with reference to the particular embodiment thereof shown in the drawing, it should be realized that various changes and modifications may be made therein without departing from the spirit and scope of the invention. For example, the oxidizer means 30 need not be in the form of a plug inserted in the very end of the working cavity at the condenser end of the heat pipe. Rather, the oxidizer means 30 may be in any form or desired shape and placed at any location within the working cavity 50 within the condenser portion 25 of the heat pipe 10. For example, the oxidizer means 30 may comprise metal oxide in a particulate, powder or thread form disposed at more than one location within the working cavity 50 in the condenser portion 25 of the heat pipe 10 or housed within a gas permeable container means, such as a stainless steel or copper wire mesh vessel, preferably disposed in the working cavity 50 of the heat pipe 10 at the end of the condenser portion 25 thereof adjacent the end cap 90. Additionally, it is to be understood that the heat pipe 10 of the present invention need not be disposed in the vertical orientation shown in the drawing, but rather may be disposed at an acute angle to the horizontal so long as the end of the condenser portion 25 lies upwardly of the evaporator portion 15 of the heat pipe.

We claim:

1. In a heat pipe having an enclosure defining a working cavity and using as a working fluid disposed within the working cavity a vaporizable liquid which releases hydrogen upon reaction with the enclosure, the improvement comprising oxidizer means disposed within the working cavity for oxidizing the hydrogen released from the working fluid into water, said oxidizer means comprising a mixture of copper and copper oxide.

2. An improved heat pipe as recited in claim 1 wherein said oxidizer means comprises a mixture of copper, cupric oxide and chromium oxide.

3. An improved heat pipe as recited in claim 2 wherein the chromium oxide comprises about 3% by weight of said mixture.

4. An improved heat pipe as recited in claim 2 wherein said oxidizer means comprises a mixture of copper, cupric oxide and chromium oxide sintered in air at a temperature of about 800° C. for a period of about one to two hours.

5. An improved heat pipe as recited in claim 1 wherein said oxidizer means comprises a mixture of copper and cupric oxide sintered in air at a temperature of about 800° C. for a period of about one to two hours.

6. An improved heat pipe as recited in claim 5 wherein the mixture of copper and cupric oxide comprises about one part by weight copper and about four parts by weight cupric oxide.

7. An improved heat pipe as recited in claim 1 wherein said oxidizer means comprises copper sintered in air at a temperature of about 820° C. for a period of about two to four hours to produce a cupric oxide layer on the copper.

8. An improved heat pipe as recited in claim 7 wherein the copper comprises a plurality of strands of copper wire.

9. A heat pipe using water as a working fluid enclosure defining a working cavity wherein the working fluid is contained, and having a condenser portion and an evaporator portion, said enclosure formed of a ferrous metal or alloy which reacts with water to generate hydrogen gas, and an oxidizer means for oxidizing the generated hydrogen gas to water disposed within the working cavity of said enclosure, said oxidizer means comprising a mixture of copper and copper oxide.

10. An improved heat pipe as recited in claim 9 wherein said oxidizer means comprises a mixture of copper, cupric oxide and chromium oxide.

11. An improved heat pipe as recited in claim 10 wherein the chromium oxide comprises about 3% by weight of said mixture.

12. An improved heat pipe as recited in claim 11 wherein said oxidizer means comprises a mixture of copper, cupric oxide and chromium oxide sintered in air at a temperature of about 800° C. for a period of about one to two hours.

13. An improved heat pipe as recited in claim 9 wherein said oxidizer means comprises a mixture of copper and cupric oxide sintered in air at a temperature of about 800° C. for a period of about one to two hours.

14. An improved hat pipe as recited in claim 13 wherein the mixture of copper and cupric oxide comprises about 20% by weight copper and about 80% by weight cupric oxide.

15. An improved heat pipe as recited in claim 9 wherein said oxidizer means comprises copper sintered in air at a temperature of about 820° C. for a period of about two to four hours to produce a cupric oxide layer on the copper.

16. An improved heat pipe as recited in claim 15 wherein the copper comprises a plurality of strands of copper wire.

17. A heat pipe as recited in claim 9 wherein said oxidizer means is disposed within the working cavity at the end of the condenser portion of the heat pipe.

18. A heat pipe as recited in claim 17 wherein said oxidizer means is heated while disposed within the working cavity to a temperature higher than the working temperature of the heat pipe.

* * * * *